US009719372B2

(12) United States Patent
Ballard, Jr. et al.

(10) Patent No.: US 9,719,372 B2
(45) Date of Patent: Aug. 1, 2017

(54) GAS TURBOMACHINE INCLUDING A COUNTER-FLOW COOLING SYSTEM AND METHOD

(75) Inventors: Henry Grady Ballard, Jr., Easley, SC (US); Kenneth Damon Black, Travelers Rest, SC (US); John David Memmer, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 533 days.

(21) Appl. No.: 13/461,035

(22) Filed: May 1, 2012

(65) Prior Publication Data

US 2013/0294883 A1 Nov. 7, 2013

(51) Int. Cl.
*F01D 25/12* (2006.01)
*F01D 25/14* (2006.01)

(52) U.S. Cl.
CPC ..... *F01D 25/12* (2013.01); *F01D 25/14* (2013.01); *F05D 2210/44* (2013.01)

(58) Field of Classification Search
CPC ..... F01D 11/08; F01D 25/12; F05D 2260/20
USPC ..... 415/116, 173.1, 175, 176, 220
See application file for complete search history.

(56) References Cited

U.S. PATENT DOCUMENTS 3,973,874 A 8/1976 Corsmeier et al.
4,304,093 A * 12/1981 Schulze ..... 60/806
4,332,133 A 6/1982 Schwarz et al.
4,363,599 A 12/1982 Cline et al.
5,219,268 A 6/1993 Johnson
5,259,730 A 11/1993 Damlis et al.
5,297,386 A 3/1994 Kervistin
5,363,654 A 11/1994 Lee
5,591,002 A 1/1997 Cunha et al.
5,593,278 A * 1/1997 Jourdain et al. ..... 415/173.2
6,152,685 A * 11/2000 Hagi ..... 415/14
6,179,557 B1 * 1/2001 Dodd et al. ..... 415/115
6,227,800 B1 5/2001 Spring et al.
6,419,146 B1 7/2002 Buldhaupt et al.
6,422,807 B1 * 7/2002 Leach et al. ..... 415/1
6,428,273 B1 8/2002 Keith et al.
(Continued)

FOREIGN PATENT DOCUMENTS

DE 4430302 A1 2/1996
DE 19823251 C1 7/1999
(Continued)

OTHER PUBLICATIONS

EP Search Report and Written Opinion issued May 6, 2014 in connection with corresponding EP Patent Application No. 13165921.1.
(Continued)

*Primary Examiner* — Gregory Anderson
*Assistant Examiner* — Juan G Flores
(74) *Attorney, Agent, or Firm* — Ernest G. Cusick; Hoffman Warnick LLC

(57) ABSTRACT

A gas turbomachine includes a casing assembly surrounding a portion of the gas turbomachine and a counter-flow cooling system arranged within the casing. The counter-flow cooling system is configured and disposed to guide cooling fluid through the casing assembly in a first axial direction and return cooling fluid through the casing assembly in a second axial direction that is opposite the first axial direction.

34 Claims, 7 Drawing Sheets

(56) References Cited

U.S. PATENT DOCUMENTS

| | | | | |
|---|---|---|---|---|
| 6,478,534 | B2 | 11/2002 | Bangert et al. | |
| 6,554,563 | B2 | 4/2003 | Noe et al. | |
| 6,641,363 | B2 * | 11/2003 | Barrett et al. | 415/116 |
| 6,659,714 | B1 | 12/2003 | Tiemann | |
| 6,742,783 | B1 | 6/2004 | Lawer et al. | |
| 6,769,875 | B2 | 8/2004 | Tiemann | |
| 6,779,597 | B2 | 8/2004 | DeMarche et al. | |
| 6,824,351 | B2 | 11/2004 | Endries et al. | |
| 6,877,952 | B2 | 4/2005 | Wilson | |
| 6,925,814 | B2 | 8/2005 | Wilson et al. | |
| 7,347,671 | B2 | 3/2008 | Dorling et al. | |
| 7,434,402 | B2 * | 10/2008 | Paprotna | F01D 11/24 415/115 |
| 7,798,775 | B2 | 9/2010 | Kammel et al. | |
| 8,127,553 | B2 | 3/2012 | Ekkad et al. | |
| 8,128,341 | B2 | 3/2012 | Wieghardt | |
| 8,137,055 | B2 | 3/2012 | Lang | |
| 8,403,631 | B2 | 3/2013 | Surace et al. | |
| 2002/0071762 | A1 | 6/2002 | Schroder | |
| 2003/0035722 | A1 | 2/2003 | Barrett et al. | |
| 2010/0247297 | A1 * | 9/2010 | Legare et al. | 415/173.1 |
| 2011/0027068 | A1 * | 2/2011 | Floyd et al. | 415/13 |
| 2011/0135456 | A1 | 6/2011 | Takahashi et al. | |
| 2012/0070302 | A1 | 3/2012 | Lee | |
| 2012/0247297 | A1 | 10/2012 | Kawaguchi et al. | |

FOREIGN PATENT DOCUMENTS

| | | | |
|---|---|---|---|
| EP | 1152125 | A1 | 11/2001 |
| EP | 1780376 | A1 | 5/2007 |
| EP | 1806476 | A1 | 7/2007 |
| EP | 2243933 | A1 | 10/2010 |
| EP | 2410128 | A1 | 1/2012 |
| JP | 2008-38807 | A | 2/2008 |
| JP | 2008-95693 | A | 4/2008 |

OTHER PUBLICATIONS

U.S. Appl. No. 13/461,035, Office Action 1 dated Dec. 17, 2014, 15 pages.

U.S. Appl. No. 13/461,035, Final Office Action 1 dated Apr. 22, 2015, 19 pages.

Notification of Reasons for Refusal issued in connection with corresponding JP Application No. 2013-093294 on Jan. 17, 2017.

Ballard et al., filed Jun. 7, 2016, U.S. Appl. No. 15/175,576.

* cited by examiner

GAS TURBOMACHINE INCLUDING A COUNTER-FLOW COOLING SYSTEM AND METHOD

BACKGROUND OF THE INVENTION

The subject matter disclosed herein relates to the art of turbomachines and, more particularly, to a gas turbomachine including a counter-flow cooling system.

Many turbomachines include a compressor portion linked to a turbine portion through a common compressor/turbine shaft or rotor and a combustor assembly. The compressor portion guides a compressed air flow through a number of sequential stages toward the combustor assembly. In the combustor assembly, the compressed air flow mixes with a fuel to form a combustible mixture. The combustible mixture is combusted in the combustor assembly to form hot gases. The hot gases are guided to the turbine portion through a transition piece. The hot gases expand through the turbine portion rotating turbine blades to create work that is output, for example, to power a generator, a pump, or to provide power to a vehicle. In addition to providing compressed air for combustion, a portion of the compressed airflow is passed through the turbine portion for cooling purposes.

BRIEF DESCRIPTION OF THE INVENTION

According to one aspect of the exemplary embodiment, a gas turbomachine includes a casing assembly having a counter-flow cooling system configured and disposed to guide cooling fluid through the casing assembly in a first axial direction and return cooling fluid through the casing assembly in a second axial direction that is opposite the first axial direction.

According to another aspect of the exemplary embodiment, a method of delivering cooling fluid through a gas turbomachine includes guiding a cooling fluid into a casing assembly of the turbine portion of the gas turbomachine, passing the cooling fluid into a first duct member extending axially through the casing assembly in a first direction, guiding the cooling fluid through a cross-flow duct fluidly coupled to the first duct member in a second direction, delivering the cooling fluid from the cross-flow duct into a second duct member that extends substantially parallel to the first duct member, and passing the cooling fluid through the second duct member in a third direction that is substantially opposite to the first direction.

In accordance with yet another aspect of the exemplary embodiment, a gas turbomachine includes a compressor portion, a combustor assembly fluidly connected to the compressor portion, and a turbine portion fluidly connected to the combustor assembly and mechanically linked to the compressor portion. A counter-flow cooling system is arranged in one of the compressor portion and the turbine portion. The counter-flow cooling system is configured and disposed to guide cooling fluid through the casing assembly in a first axial direction and return cooling fluid through the casing assembly in a second axial direction that is opposite the first axial direction.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
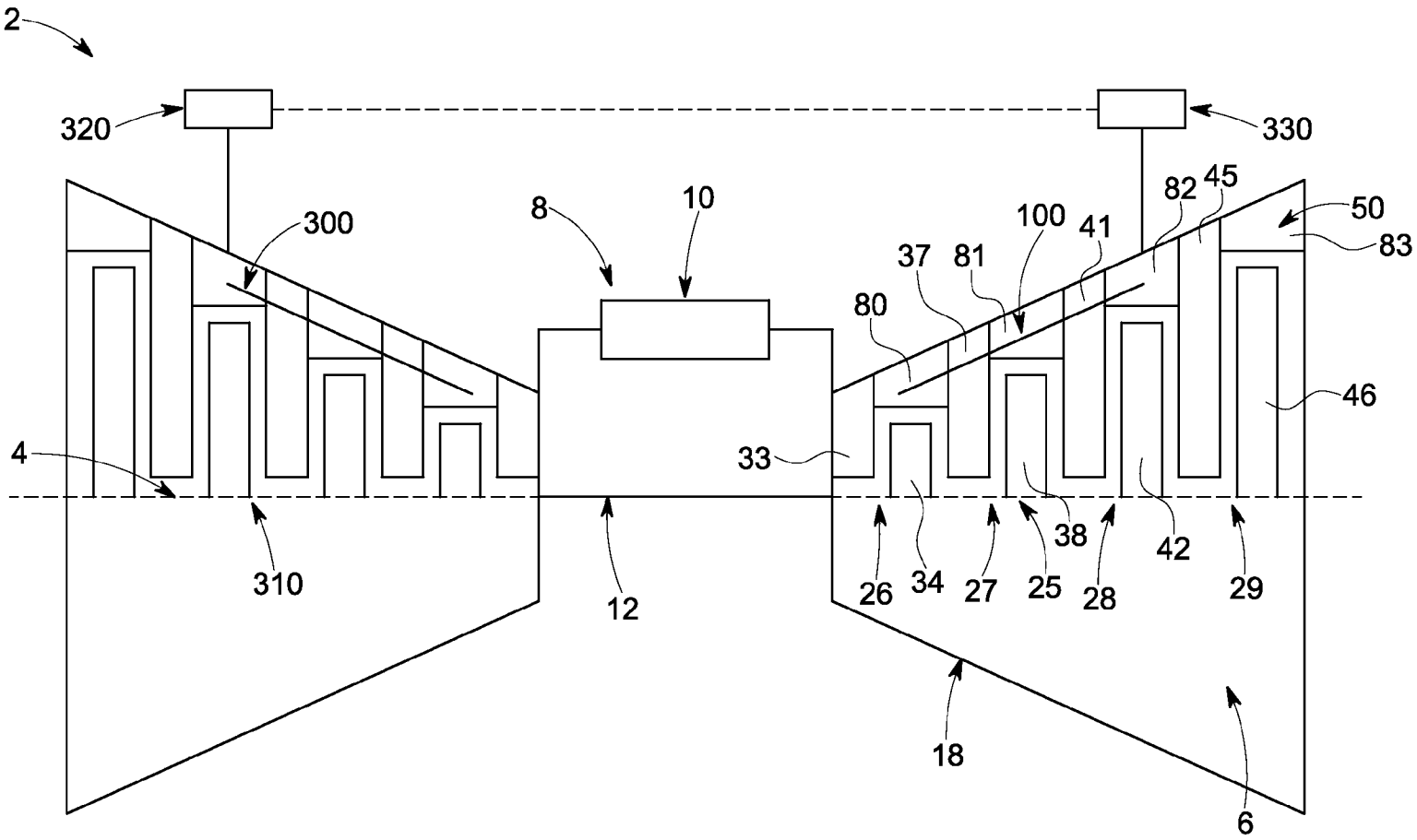
FIG. 1 is a schematic view of a gas turbomachine including a turbine portion having a counter-flow cooling system in accordance with an exemplary embodiment.
Figure 2:
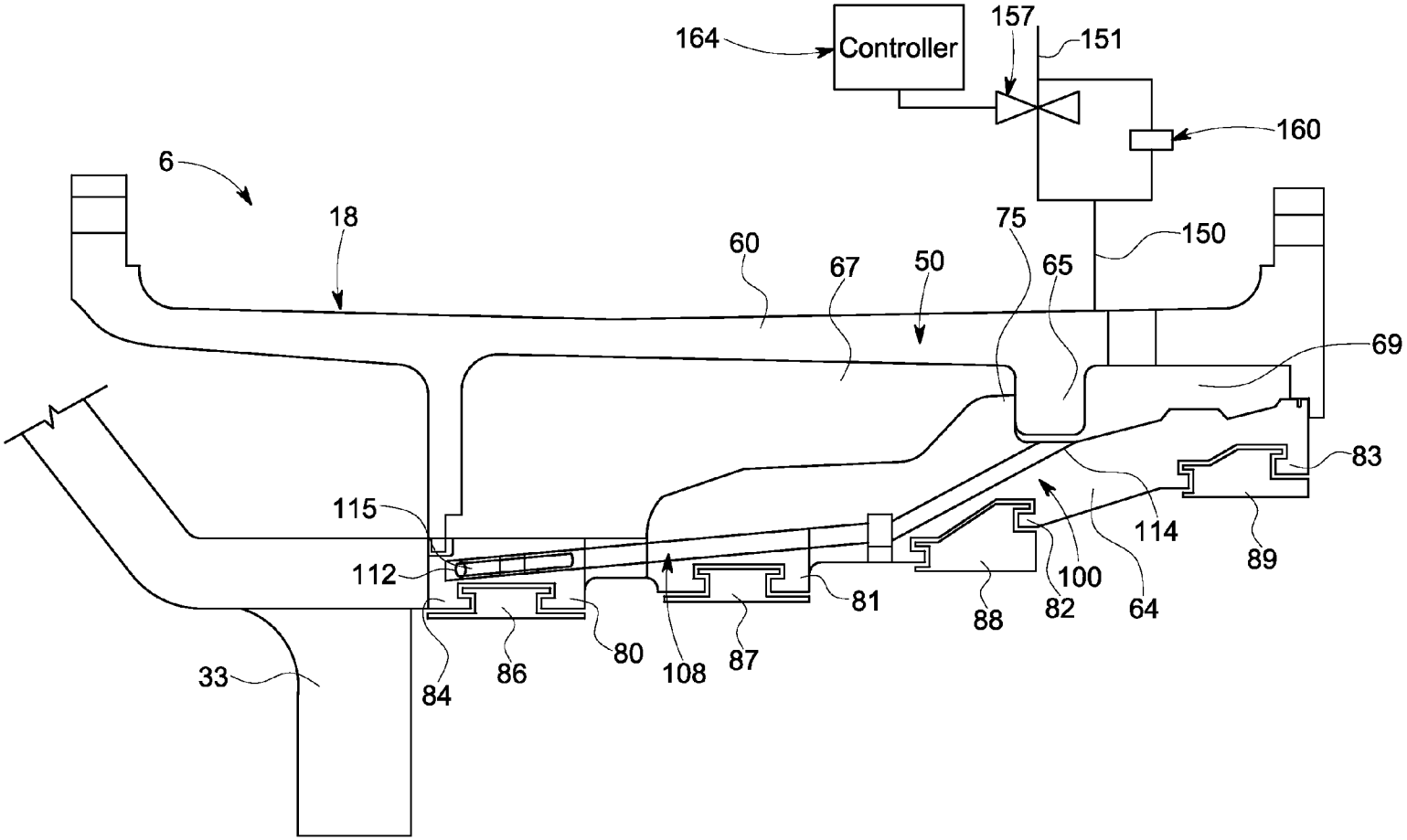
FIG. 2 is a partial cross-sectional view of the turbine portion of the gas turbomachine of FIG. 1.

With reference to FIGS. 1 and 2, a gas turbomachine in accordance with an exemplary embodiment is indicated generally at 2. Turbomachine 2 includes a compressor portion 4 and a turbine portion 6. Compressor portion 4 is fluidly connected to turbine portion 6 through a combustor assembly 8. Combustor assembly 8 includes a plurality of combustors, one of which is indicated at 10. Combustors 10 may be arranged in a can-annular array about turbomachine 2. Of course it should be understood that other arrangements of combustors 10 may also be employed. Compressor portion 4 is also mechanically linked to turbine portion 6 through a common compressor/turbine shaft 12. There are also extractions taken from various compressor stages that are fluidly connected to turbine components without passing through the combustor. These extractions are used to cool turbine components such as shrouds and nozzles on the stator, along with buckets, disks, and spacers on the rotor.

Turbine portion 6 includes a housing 18 that encloses a plurality of turbine stages 25. Turbine stages 25 include a first turbine stage 26, a second turbine stage 27, a third turbine stage 28, and a fourth turbine stage 29. First turbine stage 26 includes a first plurality of vanes or nozzles and a first plurality of rotating components in the form of blades or buckets 34. Buckets 34 are mounted to a first rotor member (not shown) that is coupled to shaft 12. Second turbine stage 27 includes a second plurality of vanes or nozzles 37 and a second plurality of blades or buckets 38. Buckets 38 are coupled to a second rotor member (not shown). Third turbine stage 28 includes a third plurality of vanes or nozzles 41 and a second plurality of blades or buckets 42 that are coupled to a third rotor member (not shown). Fourth turbine stage 29 includes a fourth plurality of vanes or nozzles 45 and a fourth plurality of blades or buckets 46 that are coupled to a fourth rotor member (not shown). Of course it should be understood that the number of turbine stages may vary.

Housing 18 includes a casing assembly 50 having an outer casing portion 60 and an inner casing portion 64. A thrust collar 65 extends from outer casing portion 60 towards inner casing portion 64. Thrust collar 65 limits axial movement of inner casing portion 64 during operation of turbomachine 2. A first plenum zone 67 is defined between outer casing portion 60 and inner casing portion 64 upstream of thrust collar 65. A second plenum zone 69 is defined between outer casing portion 60 and inner casing portion 64 downstream of thrust collar 65. First and second plenum zones 67 and 69 are fluidly connected to one or more compressor extractions (not shown). Inner casing portion 64 includes a plurality of shroud support elements 80-83. Each shroud support element 80-83 includes a pair of hook elements such as shown at 84 on shroud support element 80, that support a respective plurality of stationary shroud members 86-89. Shroud member 86-89 provide a desired clearance between inner casing portion 64 and corresponding ones of tip portions (not separately labeled) of buckets 34, 38, 42, and 46. In many cases, shroud members 86-89 include various sealing components that limit working fluid from passing over the tip portions of buckets 34, 38, 42, and 46.

Figure 3:
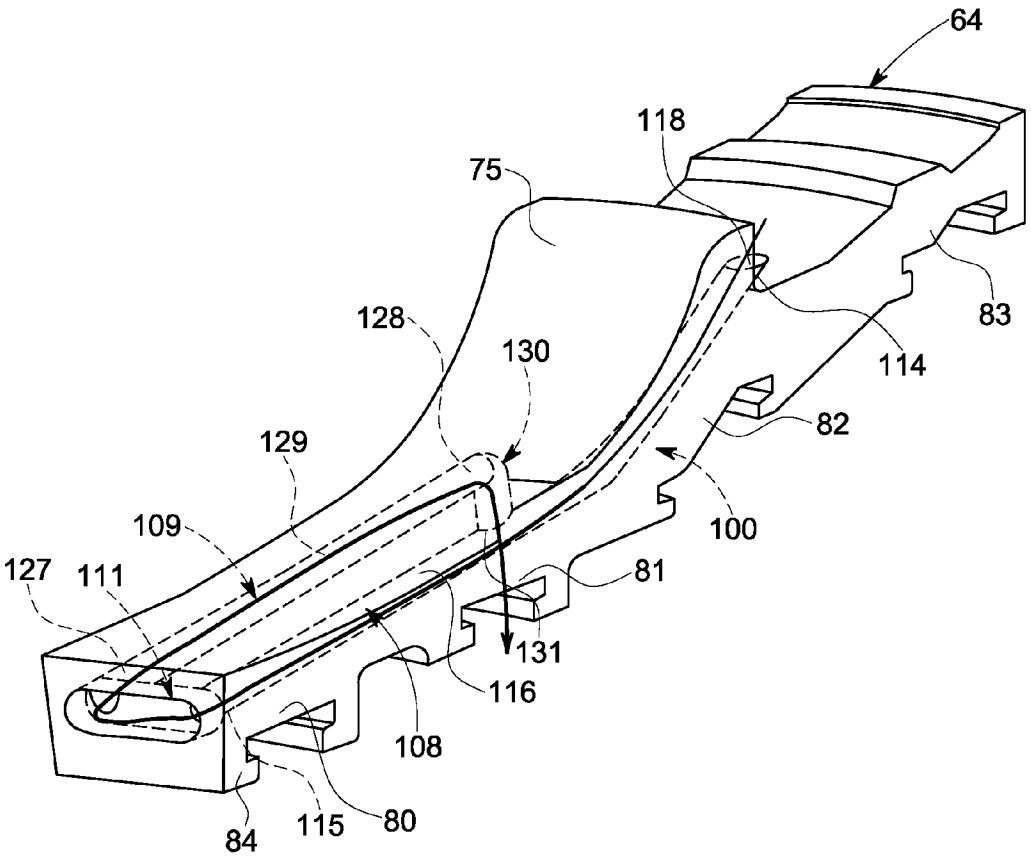
FIG. 3 is a partial perspective view of the counter-flow cooling system in accordance with an aspect of the exemplary embodiment.
Figure 4:
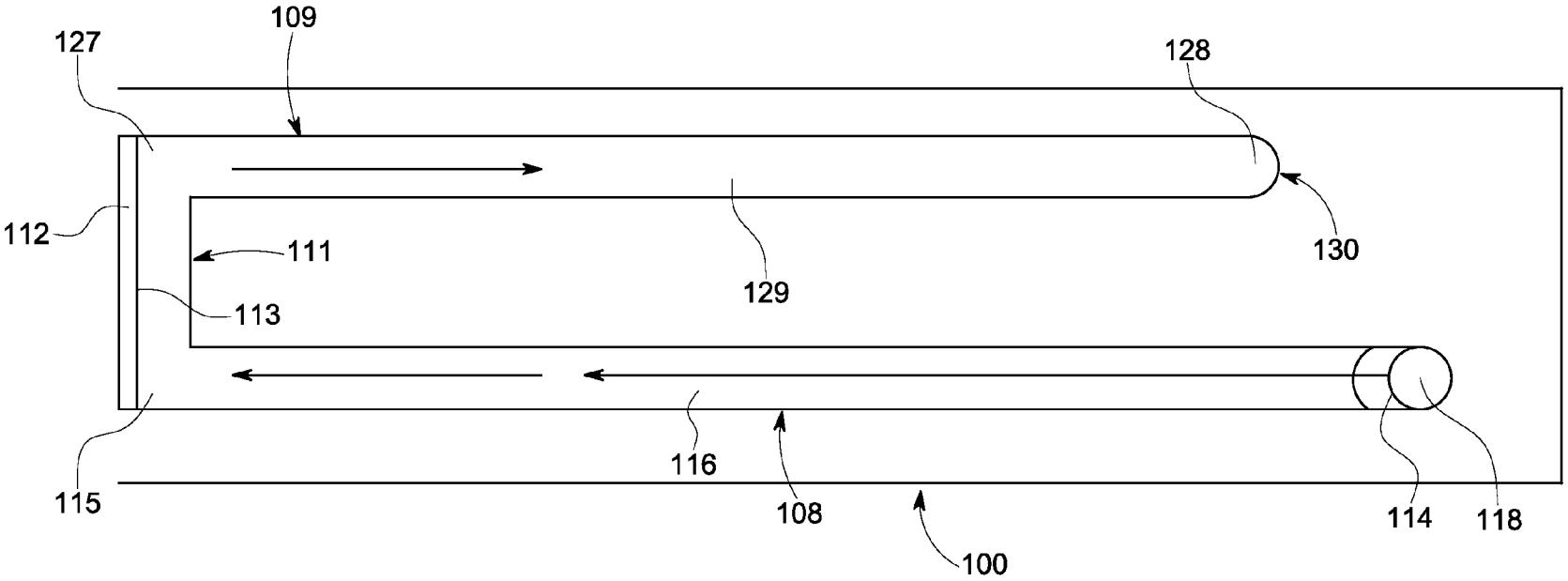
FIG. 4 is a plan view of the counter-flow cooling system of FIG. 3 illustrating a flow redirection member in accordance with one aspect of the exemplary embodiment.

In accordance with an exemplary embodiment, turbomachine 2 includes a counter-flow cooling system 100 provided in inner casing portion 64. As best shown in FIGS. 3 and 4, counter-flow cooling system 100 includes a first duct member 108 fluidly connected to a second duct member 109 by a cross-flow duct 111 having a flow redirection cap or member 112 provided with a generally linear inner surface 113. First and second duct members 108 and 109 extend axially though inner casing portion 64. In addition, first duct member 108 extends substantially parallel to second duct member 109 within inner casing portion 64. Passing cooling flow through ducts that are arranged in the manner described above reduces circumferential thermal gradients within inner casing portion 64. In addition, a deep convection flow passing within inner casing portion 64 reduces thermal gradients at shroud support 80-83. Passing cooling flow through the ducts in this particular manner reduces bulk temperatures of a plurality of turbine stages 25 to provide a desirable clearance benefit.

Figure 5:
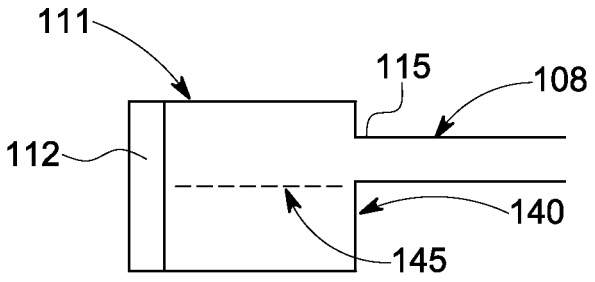
FIG. 5 is a side view of a cross-flow duct in accordance with an aspect of the exemplary embodiment.
Figure 6:
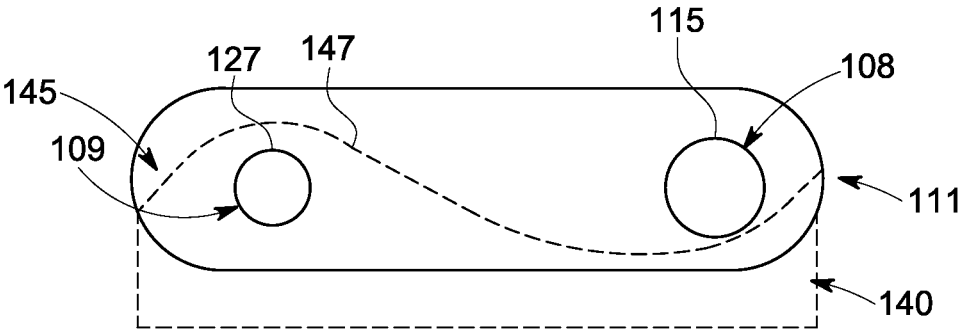
FIG. 6 is an end view of the cross-flow duct of FIG. 5.

First duct member 108 includes a first end section 114 that extends to a second end section 115 through an intermediate section 116. First end section 114 defines an inlet section 118 that is fluidly connected to second plenum zone 69 while second end section 115 connects with cross-flow duct 111. Second duct member 109 includes a first end portion 127 that extends from cross-flow duct 111 to a second end portion 128 through an intermediate portion 129. Second end portion 128 is coupled to an exit duct portion 130 having an outlet portion 131. Outlet portion 131 leads through inner casing portion 64 and fluidly connects to one or more of vanes 33, 37, 41, and 45. Cooling fluid passes from a compressor extraction (not shown) into second plenum zone 69. The cooling fluid flows into inlet section 118 and along first duct member 108. The cooling fluid then enters cross-flow duct 111 and is guided across generally linear surface 113 of flow redirection member 112 into second duct member 109 before passing into and providing cooling for the third plurality of nozzles 41. Passing cooling fluid through first duct member 108 in a first direction and through second duct member 109 in a second, opposing, direction establishes a counter-flow within inner casing portion 64. In accordance with an aspect of the exemplary embodiment illustrated in FIGS. 5 and 6, cross-flow duct 111 may be provided with an enlarged cavity area 140 and an effusion plate 145 having a plurality of openings 147 that establish a desired pressure drop between cooling flow exiting second end section 115 of first duct member 108 and cooling fluid entering first end portion 127 of second duct member 109.

Figure 7:
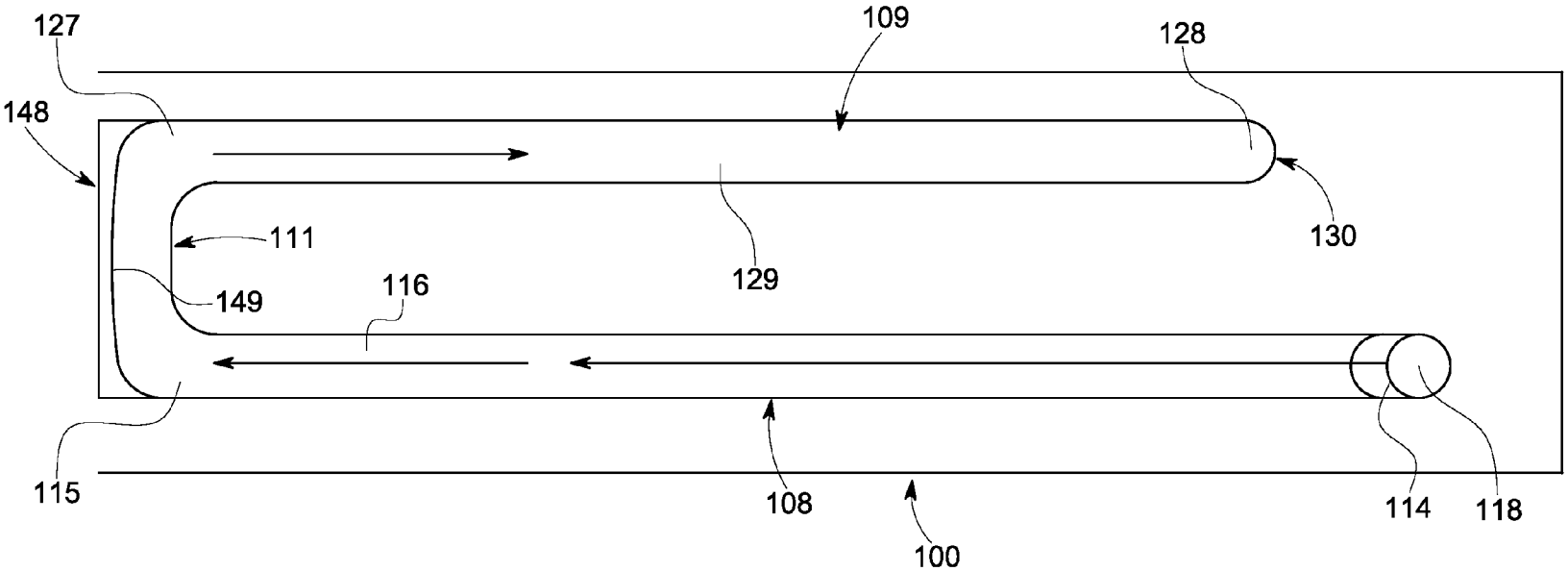
FIG. 7 is a plan view of the counter-flow cooling system of FIG. 3 including a flow redirection member in accordance with another aspect of the exemplary embodiment.

The counter flow reduces circumferential thermal gradients within inner casing portion 64 by providing a heat transfer between the cooling flow passing through first duct member 108 and the cooling flow passing through second duct member 109. Also, embedding counter flow cooling system 100 within inner casing portion 64 provides deep convection cooling that reduces thermal gradients that may occur in shroud support members 80-83, and reduces bulk temperatures of the plurality of turbine stages 25 providing a desirable clearance benefit. At this point it should be understood that cross-flow duct 111 may be provided with a flow redirection cap or member 148 having a generally curvilinear surface 149 such as shown in FIG. 7 wherein like reference numbers represent corresponding parts in the respective views. Generally curvilinear surface 149 may be adjusted to establish a desired flow characteristic within counter-flow cooling system 100.

In accordance with one aspect of the exemplary embodiment, turbomachine 2 includes a cooling fluid supply conduit 150 fluidly connected to second plenum zone 69. Cooling fluid supply conduit 150 includes an inlet 151 that is fluidly connected to a compressor extraction (not show). Cooling fluid supply conduit 150 is also shown to include a cooling fluid supply valve 157 and a cooling fluid supply valve bypass 160. Cooling fluid supply valve bypass 160 includes a metered flow orifice that allows cooling fluid to pass into second plenum zone 69 when cooling fluid supply valve 157 is closed. In this manner, cooling fluid supply valve bypass 160 maintains desired backflow pressure margins within third plurality of nozzles, 41. In further accordance with the exemplary aspect, cooling fluid supply valve 157 is operatively connected to a controller 164. Controller 164 is also coupled to various temperature sensors (not shown). Controller 164 selectively opens cooling fluid supply valve 157 to pass a desired flow of cooling fluid into second plenum zone 69.

The amount of cooling fluid passing into second plenum portion zone 69 and, more specifically, into counter-flow cooling system 100 may be employed to control a clearance between tip portions (not separately labeled) of buckets 34, 38, 42, and 46 and respective ones of shroud members 86-89. More specifically, during turbomachine start up, clearances between tip portions (not separately labeled) of buckets 34, 38, 42, and 46 and respective ones of shroud members 86-89 are larger than when turbomachine 2 is running at full speed and at full speed-full load. Between start up and full speed, and between full speed and full speed-full load, rotating components of turbomachine 2 expand at a rate that is faster than an expansion rate of stationary components such as inner casing 64, and shroud members 86-89. Different rates of thermal expansion lead to undesirable clearances between the rotating and stationary components. Controlling cooling fluid flow into counter-flow cooling system 100 more closely aligns expansion rates of the rotating components and the stationary components while turbomachine 2 transitions between start up and full speed and between full speed and full speed-full load operating conditions. Aligning the expansion rates of the rotating components and the stationary components provides tighter clearance gaps during transient and steady state operation of gas turbomachine 2. The tighter clearance gaps lead to a reduction in working fluid losses over tip portions of the rotating components, improving turbomachine performance and efficiency.

Figure 8:
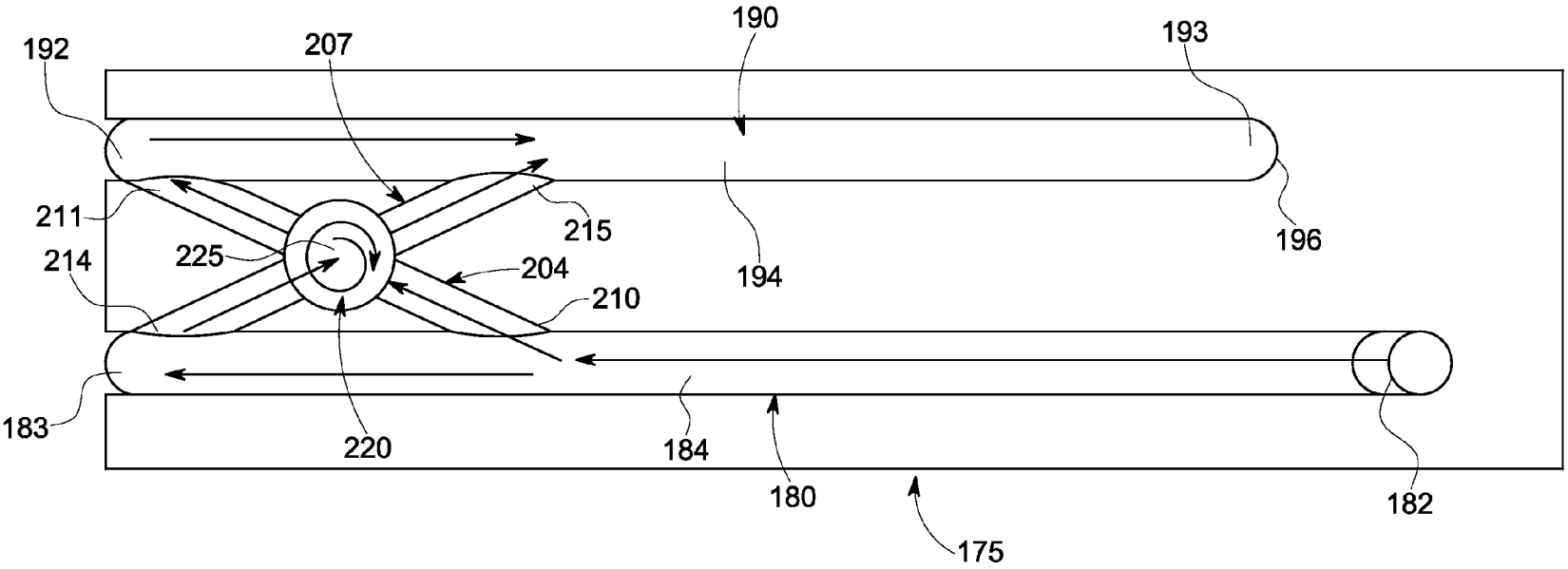
FIG. 8 is a plan view of the counter-flow cooling system in accordance with another aspect of the exemplary embodiment.

A counter-flow cooling system in accordance with another aspect of the exemplary embodiment is indicated generally at 175 in FIG. 8. Counter-flow cooling system 175 includes a first duct member 180 having a first end section 182 that extends to a second end section 183 through an intermediate section 184. Counter-flow cooling system 175 also includes a second duct member 190 that extends generally parallel to first duct member 180 within inner casing portion 64. Second duct member 190 includes a first end portion 192 that extends to a second end portion 193 through an intermediate portion 194. Second end portion 193 is fluidly connected to an exit duct 196 that fluidly connects with the third plurality of nozzles 41.

First duct member 180 is joined to second duct member 190 by a first cross-flow duct 204 and a second cross-flow duct 207. First cross-flow duct 204 includes a first inlet 210 fluidly coupled to intermediate section 185 of first duct member 180 and a first outlet 211 fluidly connected to first end portion 192 of second duct member 190. Second cross-flow duct 207 includes a second inlet 214 that is fluidly connected to second end section 183 of first duct member 180 and a second outlet 215 that is fluidly connected to intermediate portion 194 of second duct member 190. First cross-flow duct 204 is joined to second cross-flow duct 207 by a cross-over duct 220. Cross-over duct 220 establishes a mixing zone 225 for cooling fluid passing through first cross-flow duct 204 and second cross-flow duct 207. Mixing zone 225 aids in equalizing temperatures of the cooling fluid passing through first cross-flow duct 204 and second cross-flow duct 207 to reduce thermal gradients within inner casing portion 64, lowering reducing thermal gradients and bulk temperatures in counter-flow cooling system 175.

At this point it should be understood that the exemplary embodiments provide a counter-flow cooling system for reducing bulk metal temperature and thermal gradients within a turbine portion of a turbomachine. The system also provides deep convection cooling to stationary components, such as inner casings, shroud members, and the like positioned along a gas path of the turbine. In this manner, the counter-flow cooling system may more closely match or align thermal expansion of stationary turbine components and rotating turbine components. Moreover, cooling flow through the counter-flow cooling system may be selectively controlled to align thermal expansion rates of the stationary components and the rotating components through various operating phases of the turbine. The alignment of the thermal expansion rates reduces clearance gaps between the stationary components and the rotating components particularly when transitioning from one operating phase to another operating phase. The reduction in clearance gaps leads to a reduction in losses in working fluid along the hot gas path, improving performance and efficiency.

It should also be understood that while described as being associated with turbine portion 6, a counter-flow cooling system 300 may also be integrated into compressor portion 4 to improve clearances for compressor stages 310. It should be further understood that the counter-flow cooling systems in accordance with the exemplary embodiments may be coupled to external heat exchangers 320 and 330 fluidically connected to compressor portion 4 and turbine portion 6. External heat exchangers 320 and 330 may also be fluidically coupled one to another in accordance with an aspect of the exemplary embodiment to guide cooling flow from the compressor portion to the counter-flow cooling system in the turbine portion. In accordance with one aspect of the exemplary embodiment, counter-flow cooling system 300 might extract gases from an upstream section (aft of for example a sixth stage) of compressor portion 4, pass the gases through external heat exchanger 320 and then a casing portion (not separately labeled) of compressor portion 4 and onto turbine section 6. The gassing flowing through compressor portion 4 will enhance uniformity of thermal expansion thereby allowing designers to employ tighter tip clearance tolerance to enhance compressor efficiency. The presence of one or more external heat exchangers provides additional conditioning to the cooling flow to further enhance clearance control with gas turbomachine 2.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A gas turbomachine comprising:

a casing assembly that includes at least one arcuate casing component, the casing assembly surrounding a portion of the gas turbomachine, wherein the casing assembly includes an outer casing portion and an inner arcuate casing portion; and an open-loop counter-flow cooling system contained within the arcuate casing component, the counter-flow cooling system being configured and disposed to guide cooling fluid through the arcuate casing component in a first axial direction and return cooling fluid through the arcuate casing component in a second axial direction that is opposite the first axial direction, the cooling fluid being discharged into a hot gas path of the gas turbomachine, the counter-flow cooling system being arranged within the inner arcuate casing portion of the casing assembly, wherein the inner arcuate casing portion includes a plurality of shroud support elements, the counter-flow cooling system extending through at least two of the plurality of shroud support elements, wherein the at least two of the plurality of shroud support elements are located at distinct axial positions.

2. The gas turbomachine according to claim 1, wherein the counter-flow cooling system includes a first duct member extending axially through the arcuate casing component, a second duct member spaced from and extending substantially parallel to the first duct member, and at least one cross-flow duct linking the first and second duct members.

3. The gas turbomachine according to claim 2, wherein the at least one cross-flow duct includes a flow redirection member.

4. The gas turbomachine according to claim 3, wherein the flow redirection member includes a curvilinear surface.

5. The gas turbomachine according to claim 2, wherein the at least one cross-flow duct includes a first a cross-flow duct and a second cross flow duct, each of the first and second cross-flow ducts linking the first and second duct members.

6. The gas turbomachine according to claim 5, further comprising: a cross-over duct fluidly connecting the first and second cross-flow ducts.

7. The gas turbomachine according to claim 2, wherein the first duct includes a first diameter and the second duct includes a second diameter, the second duct being spaced from the first duct by a distance no greater than five of one of the first and second diameters.

8. The gas turbomachine according to claim 7, wherein the second duct is spaced from the first duct by a distance no greater than four of one of the first and second diameters.

9. The gas turbomachine according to claim 7, wherein the second duct is spaced from the first duct by a distance of no greater than 1 of one of the first and second diameters.

10. The gas turbomachine according to claim 1, further comprising: a cooling fluid supply conduit fluidly connected to the counter-flow cooling system, the cooling fluid supply conduit including a cooling fluid supply valve that is selectively operated to deliver cooling fluid to the counter-flow cooling system.

11. The gas turbomachine according to claim 10, further comprising: a cooling fluid supply valve bypass connected in parallel to the cooling fluid supply valve, the cooling fluid supply valve bypass being configured and disposed to permit an amount of cooling fluid to pass through the counter-flow cooling system when the cooling fluid supply valve is closed.

12. The gas turbomachine according to claim 10, further comprising: a controller operatively connected to the cooling fluid supply valve, the controller being configured and disposed to selectively open the cooling fluid supply valve to deliver an amount of cooling fluid into the counter-flow cooling system.

13. The gas turbomachine according to claim 1, further comprising: an external heat exchanger fluidically connected to the counter-flow cooling system.

14. The gas turbomachine according to claim 1, wherein the counter-flow cooling system is configured to pass the cooling fluid between a plurality of stages of rotating blades in the gas turbomachine, wherein the plurality of shroud support elements further includes at least three shroud support elements, wherein a third shroud support element is located at a distinct axial location from each of the at least two shroud support elements.

15. A method of delivering cooling fluid through a gas turbomachine, the method comprising:

guiding a cooling fluid into an arcuate casing component of a casing assembly of the gas turbomachine;

passing the cooling fluid into a first duct member of an open-loop counter flow cooling system, the first duct member extending axially through and contained within the arcuate casing component in a first direction, wherein passing the cooling fluid through the first duct member includes passing the cooling fluid through at least two shroud support elements, wherein the at least two shroud support elements are located at distinct axial positions;

guiding the cooling fluid through a cross-flow duct also contained within the arcuate casing component and fluidly coupled to the first duct member in a second direction;

delivering the cooling fluid from the cross-flow duct into a second duct member also contained within the arcuate casing component that extends substantially parallel to the first duct member; and passing the cooling fluid through the second duct member in a third direction that is substantially opposite to the first direction; and discharging the cooling fluid from the second duct member into a hot gas path of the gas turbomachine.

16. The method of claim 15, wherein guiding the cooling fluid into the arcuate casing component includes guiding the cooling fluid into an inner arcuate casing portion of the casing assembly.

17. The method according to claim 16, wherein passing the cooling fluid through the at least two shroud support elements reduces circumferential thermal gradients within the inner arcuate casing portion of the casing assembly.

18. The method of claim 15, further comprising: wherein guiding the cooling fluid into the arcuate casing component includes opening a cooling fluid supply valve.

19. The method of claim 18, further comprising: bypassing the cooling fluid supply valve with an amount of cooling fluid when the cooling fluid supply valve is closed to maintain backflow margin within a nozzle element of the turbine portion.

20. The method of claim 15, further comprising: guiding a portion of the cooling fluid from the one of the first and second duct members and cross-flow duct into a nozzle element of the turbine portion.

21. The method of claim 15, wherein guiding a cooling fluid into the arcuate casing component includes delivering the cooling fluid from a compressor portion extraction into a turbine portion of the gas turbomachine.

22. The method of claim 15, wherein guiding the cooling fluid into the arcuate casing component includes passing the cooling fluid from an external heat exchanger into the casing assembly.

23. The method according to claim 15, wherein passing the cooling fluid through the at least two shroud support elements includes passing the cooling fluid across a plurality of stages of rotating blades in the gas turbomachine, wherein the at least two shroud support elements further includes at least three shroud support elements, wherein a third shroud support element is located at a distinct axial location from each of the at least two shroud support elements.

24. A gas turbomachine comprising:

a compressor portion;

a combustor assembly fluidly connected to the compressor portion; and a turbine portion fluidly connected to the combustor assembly and mechanically linked to the compressor portion, wherein the turbine portion includes a casing assembly having an outer casing portion and an inner arcuate casing portion; and an open-loop counter-flow cooling system contained within an arcuate turbine casing component within the turbine portion, the counter-flow cooling system being configured and disposed to guide cooling fluid through the arcuate turbine casing component in a first axial direction and return cooling fluid through the arcuate turbine casing component in a second axial direction that is opposite the first axial direction, the cooling fluid being discharged into a hot gas path of the gas turbomachine, the counter-flow cooling system being arranged within the inner arcuate casing portion of the casing assembly, wherein the inner arcuate casing portion includes a plurality of shroud support elements, the counter-flow cooling system extending through at least two of the plurality of shroud support elements, wherein the at least two of the plurality of shroud support elements are located at distinct axial positions.

25. The gas turbomachine according to claim 24, wherein the counter-flow cooling system includes a first duct member extending axially through the arcuate casing component, a second duct member spaced from and extending substantially parallel to the first duct member and a cross-flow duct linking the first and second duct members.

26. The gas turbomachine according to claim 25, wherein the cross-flow duct includes a flow redirection member.

27. The gas turbomachine according to claim 5, wherein the flow redirection member includes a curvilinear surface.

28. The gas turbomachine according to claim 24, further comprising:

a cooling fluid supply conduit fluidly connected to the counter-flow cooling system, the cooling fluid supply conduit including a cooling fluid supply valve that is selectively operated to delivery cooling fluid to the counter-flow cooling system; and a controller operatively connected to the cooling fluid supply valve, the controller being configured and disposed to selectively open the cooling fluid supply valve to deliver an amount of cooling fluid into the counter-flow cooling system.

29. The gas turbomachine according to claim 24, further comprising: an external heat exchanger fluidically connected to the counter-flow cooling system.

30. The gas turbomachine according to claim 24, wherein the counter-flow cooling system is configured to pass the cooling fluid across a plurality of stages of rotating blades in the gas turbomachine, wherein the plurality of shroud support elements further includes at least three shroud support elements, wherein a third shroud support element is located at a distinct axial location from each of the at least two shroud support elements.

31. A method of passively controlling turbine bucket tip clearances in a gas turbomachine comprising:

guiding a cooling fluid into an open-loop counter flow cooling system contained within an arcuate casing component of a casing assembly of the gas turbomachine;

flowing the cooling fluid through the arcuate casing component in a first axial direction;

passing the cooling fluid circumferentially through the arcuate casing component;

flowing the cooling fluid through the arcuate casing component in a second axial direction that is opposite to the first direction, wherein passing the cooling fluid in the first axial direction and flowing the cooling fluid in the second axial direction includes passing the cooling fluid through an inner arcuate casing portion of the casing assembly, wherein the inner arcuate casing portion includes a plurality of shroud support elements, wherein the cooling fluid is flowed through at least two of the plurality of shroud support elements wherein the at least two of the plurality of shroud support elements are located at distinct axial positions;

discharging the cooling fluid into a hot gas path of the gas turbomachine; and reducing thermal gradients in the casing assembly to control a clearance between turbine bucket tip portions and shroud members supported at the arcuate casing component.

32. The method of claim 31, wherein passing the cooling fluid in the first axial direction and the second axial direction includes passing the cooling fluid through shroud supports that are coupled to respective ones of the shroud members.

33. The method of claim 31, wherein, reducing thermal gradients in the casing to control a clearance between turbine bucket tip portions and shroud members supported at the casing includes reducing thermal gradients over a range of turbomachine operating conditions.

34. The method according to claim 31, wherein passing the cooling fluid through the at least two shroud support elements includes passing the cooling fluid across a plurality of stages of rotating blades in the gas turbomachine, wherein the at least two shroud support elements further includes at least three shroud support elements, wherein a third shroud support element is located at a distinct axial location from each of the at least two shroud support elements.

* * * * *